US009892844B2

(12) United States Patent
Park et al.

(10) Patent No.: US 9,892,844 B2
(45) Date of Patent: Feb. 13, 2018

(54) COIL UNIT FOR THIN FILM INDUCTOR, METHOD OF MANUFACTURING COIL UNIT FOR THIN FILM INDUCTOR, THIN FILM INDUCTOR, AND METHOD OF MANUFACTURING THIN FILM INDUCTOR

(71) Applicant: Samsung Electro-Mechanics Co., Ltd., Suwon-Si (KR)

(72) Inventors: Jeong Woo Park, Suwon-Si (KR); Dong Min Kim, Busan (KR)

(73) Assignee: Samsung Electro-Mechanics Co., Ltd., Suwon-si (KR)

( * ) Notice: Subject to any disclaimer, the term of this patent is extended or adjusted under 35 U.S.C. 154(b) by 0 days.

(21) Appl. No.: 14/822,440

(22) Filed: Aug. 10, 2015

(65) Prior Publication Data

US 2016/0086721 A1 Mar. 24, 2016

(30) Foreign Application Priority Data

Sep. 24, 2014 (KR) ..... 10-2014-0127618

(51) Int. Cl.
*H01F 5/00* (2006.01)
*H01F 27/28* (2006.01)
*H01F 41/04* (2006.01)

(52) U.S. Cl.
CPC ..... *H01F 27/2804* (2013.01); *H01F 41/042* (2013.01); *H01F 2027/2809* (2013.01)

(58) Field of Classification Search
CPC ..... H01F 27/2804; H01F 27/24; H01F 27/28; H01F 2027/2809; H01F 41/042; H01F 41/04
USPC ..... 336/200, 223, 232; 29/605
See application file for complete search history.

(56) References Cited

U.S. PATENT DOCUMENTS

2004/0056749 A1* 3/2004 Kahlmann ..... H01L 27/08 336/200
2008/0001701 A1* 1/2008 Gardner ..... H01F 3/12 336/223
2010/0148905 A1* 6/2010 Matsumoto ..... H01F 41/041 336/137
2013/0244343 A1* 9/2013 Chang ..... H01L 23/5329 438/3

FOREIGN PATENT DOCUMENTS

KR 10-1999-0066108 A 8/1999

* cited by examiner

*Primary Examiner* — Mangtin Lian
(74) *Attorney, Agent, or Firm* — NSIP Law

(57) ABSTRACT

A coil unit for a thin film inductor includes an insulating material having double insulating layers of a first and a second insulating layers; and a plurality of coil patterns formed to be embedded in the insulating material. At least one coil pattern among the coil patterns has a thickness different from a thickness of rest of the coil patterns.

9 Claims, 8 Drawing Sheets

200

COIL UNIT FOR THIN FILM INDUCTOR, METHOD OF MANUFACTURING COIL UNIT FOR THIN FILM INDUCTOR, THIN FILM INDUCTOR, AND METHOD OF MANUFACTURING THIN FILM INDUCTOR

CROSS REFERENCE(S) TO RELATED APPLICATIONS

This application claims the foreign priority benefit under 35 U.S.C. Section [120, 119, 119(e)] of Korean Patent Application Serial No. 10-2014-0127618, entitled "Coil Unit for Thin Film Inductor, Method of Manufacturing Coil Unit for Thin Film Inductor, Thin Film Inductor, and Method of Manufacturing Thin Film Inductor" filed on Sep. 24, 2014, which is hereby incorporated by reference in its entirety into this application.

BACKGROUND

1. Technical Field

Embodiments of the present invention relates to a coil unit for a thin film inductor, a method of manufacturing a coil unit for a thin film inductor, a thin film inductor, and a method of manufacturing a thin film inductor.

2. Description of the Related Art

Recently, with the development of electronics industry, miniaturization and high functionalization of electronic products including a mobile phone are rapidly proceeding, and accordingly, the parts used in electronic products are inevitably needed to be light, be small, and perform a high performance. Therefore, in the development field of an inductor used in the electronic product also, miniaturization and thinness are coming to the fore, as a more important task.

According to this trend, development of an inductor having compatible miniaturization and thinness, as well as high functionalization properties is being focused, and as the inductor, a thin film inductor is recently developed, and put into practice.

Until now, as a thin film inductor, a coil unit wherein coil patterns are formed on the upper and the lower sides of an insulating substrate is mainly adopted.

However, since the coil unit for a thin film inductor having the above structure has coil patterns formed on the upper and the lower sides of an insulating substrate, the total thickness of the coil unit is increased, and also a difficulty in designing thin film inductor characteristics and the like may be generated, due to plating thickness distribution, short between patterns, and the like.

Therefore, the development of a coil unit for a thin film inductor capable of corresponding to the recent trend to favor small and thin devices, and also more freely designing thin film inductor properties and the like, and a thin film inductor having the coil unit, is currently needed.

SUMMARY

One object of the present disclosure is to provide a coil unit for a thin film inductor capable of miniaturization and thinness, and more freely designing thin film inductor properties, a method of manufacturing the coil unit, a thin film inductor, and a method of manufacturing the thin film inductor.

In addition, another object of the present disclosure is to provide a coil unit for a thin film inductor simplifying a manufacturing process to allow mass production, a method of manufacturing the coil unit, a thin film inductor, and a method of manufacturing the thin film inductor.

According to an exemplary embodiment of the present disclosure, there are provided a coil unit for a thin film inductor wherein at least one coil pattern among a plurality of coil patterns formed to be embedded in an insulating material has a thickness different from rest of the coil patterns, a method of manufacturing the coil unit, a thin film inductor, and a method of manufacturing the thin film inductor.

According to another exemplary embodiment of the present disclosure, there are provided a coil unit for a thin film inductor, a method of manufacturing the coil unit, a thin film inductor, and a method of manufacturing the thin film inductor, adopting a process of forming circuit patterns on each of a pair of metal layers each bonded to both surfaces of a substrate layer by adhesive layers, and then separating the circuit patterns.

Additional aspects and/or advantages will be set forth in part in the description which follows and, in part, will be apparent from the description, or may be learned by practice of the invention.

BRIEF DESCRIPTION OF DRAWINGS

These and/or other aspects and advantages will become apparent and more readily appreciated from the following description of the embodiments, taken in conjunction with the accompanying drawings of which.

DESCRIPTION OF EMBODIMENTS

Details on technical constitutions and function effects for the above objects of a coil unit for an thin film inductor according to the present disclosure, a method of manufacturing the coil unit, a thin film inductor according to the present disclosure, and a method of manufacturing the thin film inductor, will be clearly understood by following detailed description, referring to drawings illustrating the preferred exemplary embodiment of the present disclosure.

In addition, in describing the present disclosure, when it is determined that the detailed description of the known art related to the present disclosure may unnecessarily obscure the gist of the present disclosure, the detailed description thereof will be omitted. In the description, the terms "first", "second", and so on are used to distinguish one element from another element, and the elements are not defined by the above terms.

<Coil Unit for Thin Film Inductor>

Figure 1:
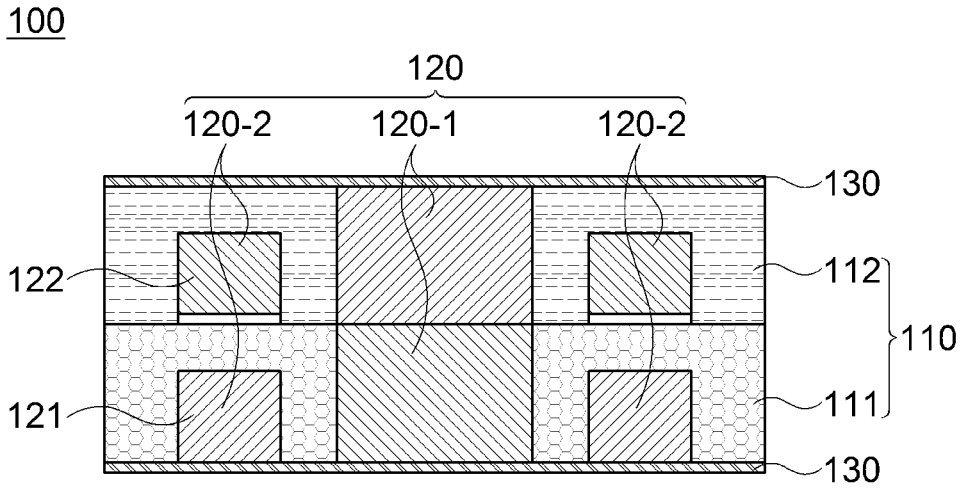
FIG. 1 is a schematic cross-sectional view of a coil unit for a thin film inductor according to an exemplary embodiment of the present disclosure.

First, FIG. 1 is a schematic cross-sectional view of a coil unit 100 for a thin film inductor according to an exemplary embodiment of the present disclosure.

As shown in FIG. 1, a coil unit 100 for a thin film inductor according to the exemplary embodiment may be formed by including an insulating material 110 and coil patterns 120.

First, the insulating material 110 may include double insulating layers, and thus, as shown in FIG. 1, include a first insulating layer 111 and a second insulating layer 112.

Herein, the first and the second insulating layers 111 and 112 of the exemplary embodiment may be formed of photosensitive insulating layers, but the present disclosure is not limited thereto, and any material having an insulating property may be used.

In addition, the first and the second insulating layers 111 and 112 embed a plurality of coil patterns 120, as shown in FIG. 1.

Herein, the exemplary embodiment exemplifies a case where the first insulating layer 111 is formed of a mixture of a prepreg (PPG) and a resin, and the second insulating layer 112 is formed of a resin type, but the present disclosure is not limited thereto, and any material capable of embedding and protecting a plurality of coil patterns 120 may be used.

Therefore, the first insulating layer 111 may be formed of a resin type, and the second insulating layer 112 may be formed of a mixture of a prepreg and a resin, and also various applications such as the insulating layer formed of at least one material or a mixture of at least two materials selected from the group consisting of an acryl-based polymer, a phenol-based polymer and a polyimide-based polymer, are possible.

In case where an insulating material 110 having a double insulating layer structure as in the present exemplary embodiment is adopted, the thickness of the insulating material is more freely adjustable, as compared with the structure having a single insulating layer. Therefore, in the present exemplary embodiment, an insulating distance between a coil pattern and a magnetic body, spacing between coils, and the like are freely adjustable, and thus, a capacitance characteristic of a thin film inductor may be formed to be more freely designed.

Next, coil patterns 120 may be formed to be embedded in the insulating material 110, and included in a plural number, as shown in FIG. 1.

As in the present exemplary embodiment, a plurality of coil patterns 120 are formed to be embedded in the insulating material 110, thereby reducing the total thickness of the coil unit, as compared with a coil unit having coil patterns formed on the upper and the lower sides of the insulating material, and thus, the miniaturization and thinness of the thin film inductor having the coil unit may be achieved.

In addition, in the coil patterns 120, at least one coil pattern has a thickness different from that of rest of the coil patterns. The present exemplary embodiment exemplifies the case where one coil pattern 120-1 has a thickness different from that of rest of the coil patterns 120-2, as shown in FIG. 1, but the present disclosure is not limited thereto, and of course, a structure wherein two or more coil patterns have a thickness different from that of rest of the coil patterns, may be adopted.

As in the present exemplary embodiment, at least one coil pattern has a thickness different from that of rest of the coil patterns in the formation of the coil for a thin film inductor, thereby adjusting and forming each of the cross-sectional areas of coil patterns differently through such thickness adjustment, and accordingly, thin film inductor characteristics such as impedance may be formed to be more freely designed.

Meanwhile, the coil patterns 120 of the present exemplary embodiment may include first and second plating layers 121 and 122, as shown in FIG. 1.

The first plating layer 121 is formed to be embedded in the first insulating layer 111 of the insulating material 110, and in the present exemplary embodiment, formed to be embedded from the lower surface of the first insulating layer 111, as shown in FIG. 1.

Herein, the first plating layer 121 may be formed of at least one material or a mixture of at least two materials selected from the group consisting of copper (Cu), gold (Au), silver (Ag), aluminum (Al) and nickel (Ni), but the present disclosure is not limited thereto.

In addition, the second plating layer 122 is formed to be embedded in the second insulating layer 112 of the insulating material 110, and in the present exemplary embodiment, formed to be embedded from the lower surface of the second insulating layer 112, as shown in FIG. 1.

Herein, the second plating layer 122 may be formed of at least one material or a mixture of at least two materials selected from the group consisting of copper (Cu), gold (Au), silver (Ag), aluminum (Al) and nickel (Ni), like the first plating layer 121, but the present disclosure is not limited thereto.

In addition, the first and second plating layers 121 and 122 may be formed by unidirectional plating, as shown in FIG. 1, but the present disclosure is not limited thereto, and of course, they may be formed by not only unidirectional plating, but also bidirectional plating, and the like.

Meanwhile, at least one of the first and second plating layers 121 and 122 of coil patterns 120 may be formed of a plurality of plating layers. In the present exemplary embodiment, the second plating layer 122 embedded and formed in the second insulating layer 112 is formed of a plurality of plating layers, as shown in FIG. 1, but the present disclosure is not limited thereto, and the first plating layer 121 embedded and formed in the first insulating layer 111 may be also formed of a plurality of plating layers.

As previously described, the plating layer of the coil patterns is formed of plural layers, through which the cross-sectional area of the coil patterns is adjustable, and thus, a degree of design freedom of thin film inductor characteristics (for example, an impedance property) may be more improved.

Meanwhile, the coil unit 100 for a thin film inductor according to the present exemplary embodiment may further include a conductive via hole (not shown) for electrical connection between each coil pattern, and external circuit patterns. That is, within the insulating material 110, a via hole is processed by a mechanical method, a laser or photolithographic process, or the like, and the via hole is plated by a process such as desmear and chemical copper to form a conductive via hole.

In addition, the coil unit 100 for a thin film inductor according to the present exemplary embodiment, may have solder resist 130 for insulation on the upper and the lower surfaces of the insulating material 110, that is, the lower surface of the first insulating layer 111 and the upper surface of the second insulating layer 112, as shown in FIG. 1. However, the present disclosure is not limited thereto, and thus, the solder resist 130 may be formed only on a portion of the first plating layer 121 exposed to the lower surface of the first insulating layer 111, and a portion of the second plating layer 122 exposed to the upper surface of the second insulating layer 112, and further, any insulating resist capable of protecting the exposed portion of the first and second plating layers 121 and 122 may be used.

<Method of Manufacturing Coil Unit for Thin Film Inductor>

Figure 2:
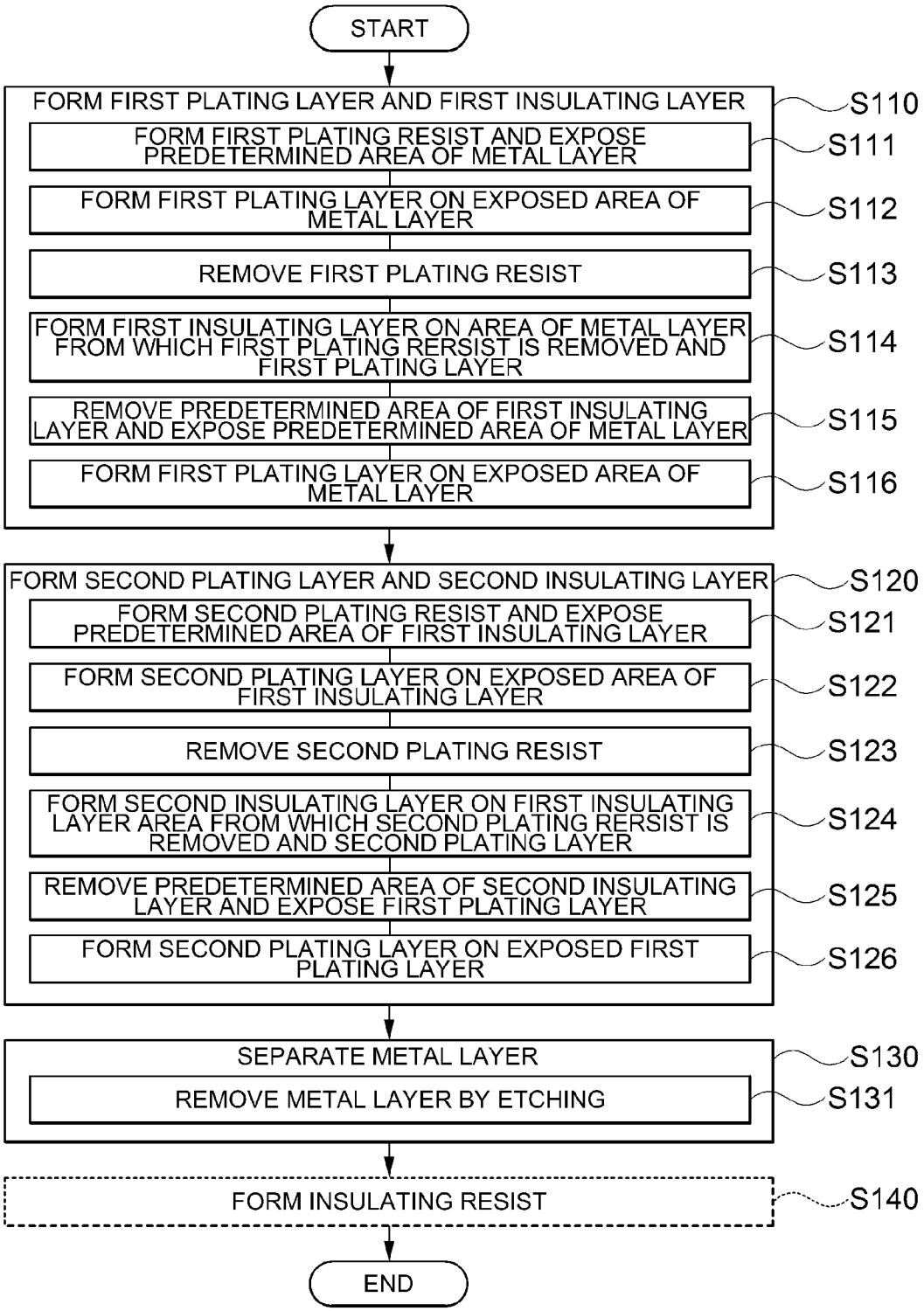
FIG. 2 is a flowchart for describing a method of manufacturing a coil unit for a thin film inductor according to an exemplary embodiment of the present disclosure.

First, FIG. 2 is a flowchart for describing a method of manufacturing a coil unit for a thin film inductor according to an exemplary embodiment of the present disclosure.

Referring to FIG. 2, a method of manufacturing the coil unit for a thin film inductor according to an exemplary embodiment of the present disclosure may include forming a first plating layer on each of a pair of metal layers each bonded to both surfaces of a substrate layer by adhesive layers, and forming a first insulating layer to embed the first plating layer (S110); forming a second plating layer, and forming a second insulating layer to embed the second plating layer (S120); and separating a pair of metal layers from a substrate layer (S130). The method may further include forming insulating resist (S140), after separating the metal layers (S130). Herein, at least one coil pattern of a plurality of coil patterns including the first and second plating layers is formed to have a thickness different from that of rest of the coil patterns.

Figure 3:
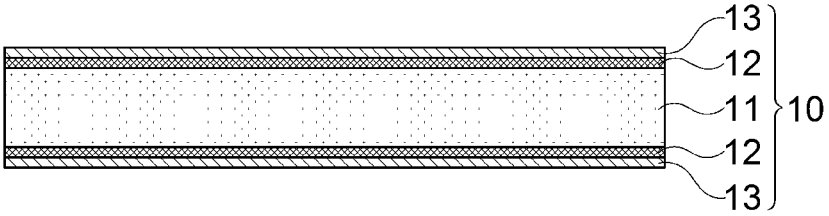
FIG. 3 is a schematic cross-sectional view of a carrier used in a method of manufacturing a coil unit for a thin film inductor according to the exemplary embodiment.

The present exemplary embodiment may adopt a manufacturing method using a carrier shown in FIG. 3, and FIG. 3 represents a schematic cross-sectional view of a carrier used in the method of manufacturing the coil unit for a thin film inductor according to the present exemplary embodiment.

The method of manufacturing the coil unit for a thin film inductor according to the present exemplary embodiment may use a carrier 10 having a pair of metal layers 13 each bonded to both surfaces of a substrate layer 11 by adhesive layers 12, as shown in FIG. 3.

Herein, the carrier 10 may include the substrate layer 11, a pair of adhesive layers 12 each stacked on both surfaces of the substrate layer 11, and a pair of metal layers 13 each bonded to a pair of adhesive layers 12, as shown in FIG. 3.

The adhesive layers 12 formed on both surfaces of the substrate layer 11 may be divided into two pieces by the substrate layer 11 to individually separate the metal layers each bonded to the adhesive layers. As the substrate layer 11, paper, non-woven fabric, or a synthetic resin such as polyethylene, polypropylene and polybutylene, may be used.

The adhesive layers 12 may be stacked on both surfaces of the substrate layer 11, respectively, and the adhesive strength of the adhesive layer may be reduced by a predetermined factor, which may be ultraviolet rays or heat.

The metal layers 13 bonded by the adhesive layers 12 should be easily separated from the substrate layer 11 by reducing the adhesive strength of the adhesive layers 12 by a predetermined factor, after being bonded to the adhesive layers 12.

An adhesive forming the adhesive layers 12 may have reduced adhesive strength by the physical properties of the adhesive changed by a predetermined factor, so that the metal layers 13 are easily separated from the substrate layer 11.

For example, in case where an adhesive in which a material generating gas by UV irradiation is combined, is used to form the adhesive layer 12, when irradiating UV for separating the metal layers 13, gas is generated within the adhesive layers 12 to change the volume of the adhesive layers 12, thereby reducing the adhesive strength.

In addition, in case where a foamable adhesive in which a material to be foamed by heat of a predetermined temperature is combined, is used to form the adhesive layer 12, when applying heat of a predetermined temperature, foam is generated within the adhesive layers 12 to form unevenness of bonded surfaces, thereby reducing the adhesive strength.

The metal layers 13 are bonded to the adhesive layers 12 on the substrate layer 11, and if necessary, separated from the substrate layer 11.

For example, according to the manufacturing method of the present exemplary embodiment, an embossed first plating layer 121 is formed on each of a pair of metal layers 13, the first plating layer 121 is embedded in a first insulating layer 111, on which a second plating layer 122 is formed to be embedded in the second insulating layer 112, and thereafter, a pair of metal layers 13 are separated from the substrate layer 11, thereby manufacturing two coil units for a thin film inductor in which circuit patterns are formed to be embedded in an insulating material 110 at the same time.

As previously described, the present exemplary embodiment adopts a process of using a carrier 10, more particularly, a process of forming circuit patterns on each of a pair of the metal layer 13 of the carrier 10, and then separating each of the metal layers 13 on which circuit patterns are formed, thereby manufacturing two coil units for a thin film inductor in one process. Accordingly, the simplification of the manufacturing process allows mass production.

Meanwhile, the separation of the metal layer 13 from the substrate layer 11 may be carried out by reducing the adhesive strength of the adhesive layer 12 interposed between the substrate layer 11 and the metal layer 13. That is, when the adhesive strength of the adhesive layer 12 is reduced by applying a predetermined factor to an adhesive, the metal layer 13 may be separated from the substrate layer 11.

The metal layer 13 may be formed of a conductive metal, and in this case, the conductive metal may be at least one selected from the group consisting of copper (Cu), gold (Au), silver (Ag), nickel (Ni), palladium (Pd) and platinum (Pt), but the present disclosure is not limited thereto, and various applications such as the metal layer 13 formed of one of the metals, or the metal layer 13 formed of a combination of the metals, are possible.

The drawings as described below are process charts illustrating a method of manufacturing a coil unit for a thin film inductor according to an exemplary embodiment of the present disclosure, through which each step of the manufacturing method is described in detail, as follows.

First, FIGS. 4A to 4D are process charts illustrating operation S110 of FIG. 2, that is, a step of forming a first plating layer and a first insulating layer.

As illustrated in FIGS. 2 and 4A to 4D, a step of forming the first plating layer and the first insulating layer according to the present exemplary embodiment (S110) may include a step of forming first plating resist corresponding to a first plating layer of coil patterns having an identical thickness among a plurality of coil patterns on each of a pair of metal layers, thereby exposing predetermined areas of metal layers (S111), a step of forming first plating resist of coil patterns having an identical thickness on the areas of the metal layers exposed in operation S111 (S112), a step of removing the first plating resist formed in operation S111 (S113), a step of forming a first insulating layer on the areas of the metal layers from which the first plating resist is removed in operation S113, and the first plating layer of coil patterns having an identical thickness (S114), a step of removing a portion of the first insulating layer corresponding to the first plating layer of coil patterns having a different thickness among a plurality of coil patterns, thereby exposing predetermined areas of the metal layers (S115), and a step of forming the first plating layer of coil patterns having a different thickness on the areas of metal layers exposed in operation S115 (S116).

Figure 4A:
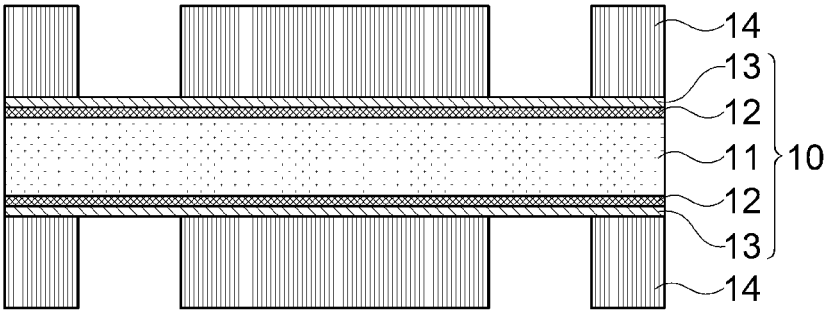
FIGS. 4A through 4D are process charts illustrating a step of forming a first plating layer and a first insulating layer of FIG. 2.

Reviewing the step of forming of the first plating layer and the first insulating layer (S110) according to the present exemplary embodiment more specifically, first, as shown in FIG. 4A, first plating resist 14 corresponding to a first plating layer of coil patterns having an identical thickness among a plurality of coil patterns is formed on each of a pair of metal layers 13 of a carrier 10, so that the predetermined areas of the metal layers 13 (the areas of the first plating layer of coil patterns having an identical thickness) may be exposed (S111).

Herein, as the first plating resist 14, dry film resist (DFR) may be used, but the present disclosure is not limited thereto, and if a plating layer of coil patterns is formable, any type of resist pattern such as photoresist is possible.

Figure 4B:
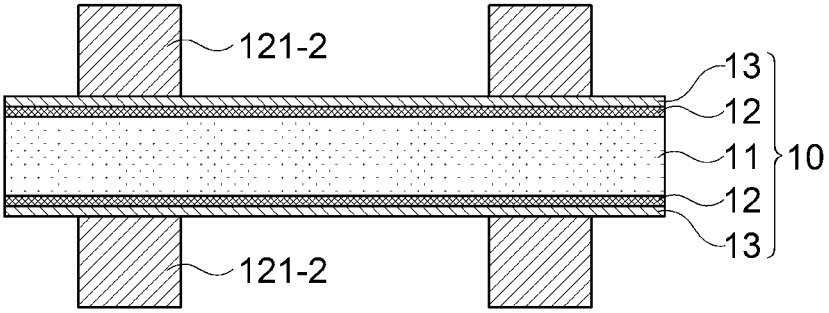

Further, as shown in FIG. 4B, electroplating may be carried out using the metal layer 13 as an electrode, so that the areas of metal layers exposed in operation S111 (the areas of metal layers where the first plating resist 14 is not formed) are filled with a conductive material, on each of a pair of the metal layers 13, thereby forming the first plating layer 121-1 of coil patterns having an identical thickness (S112).

Herein, the first plating layer 121-2 formed in operation S112 may be formed of at least one material or a mixture of at least two materials selected from the group consisting of copper (Cu), gold (Au), silver (Ag), aluminum (Al) and nickel (Ni), but the present disclosure is not limited thereto.

In addition, the first plating layer 121-2 formed in operation S112 may be formed by unidirectional plating, as shown in FIG. 4B, but the present disclosure is not limited thereto, and of course, it may be formed by not only unidirectional plating, but also bidirectional plating, and the like.

Further, by removing the first plating resist 14 by a process such as light exposure, development and the like (S113), the first plating layer 121-2 of coil patterns having an identical thickness may be formed, on each of a pair of the metal layers 13, as shown in FIG. 4B.

Figure 4C:
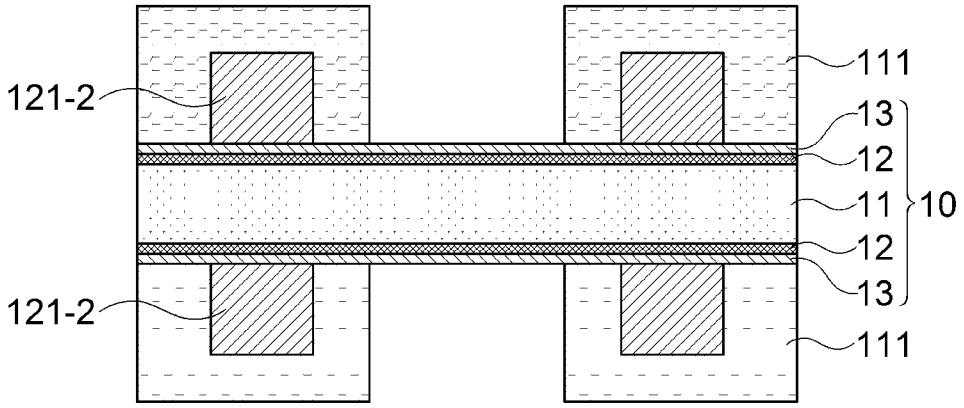

Further, a first insulating layer 111 is formed to intervene in the areas of the metal layers from which the first plating resist 14 is removed in operation S113, and the first plating layer 121-2 formed in operation S112 (S114), thereby embedding the first plating layers 121-2 formed in operation S112 in the first insulating layer 111, as shown in FIG. 4C. Herein, the insulating layer 111 may be formed of a photosensitive insulating layer, but the present disclosure is not limited thereto, and any material having an insulating property may be used.

Further, as shown in FIG. 4C, by removing the portion of the first insulating layer corresponding to the first plating layer of coil patterns having a different thickness among a plurality of coil patterns by a process such as light exposure, development, or the like, the determined areas of the metal layers 13 (the areas of the first plating layer of coil patterns having a different thickness) may be exposed again (S115).

Figure 4D:
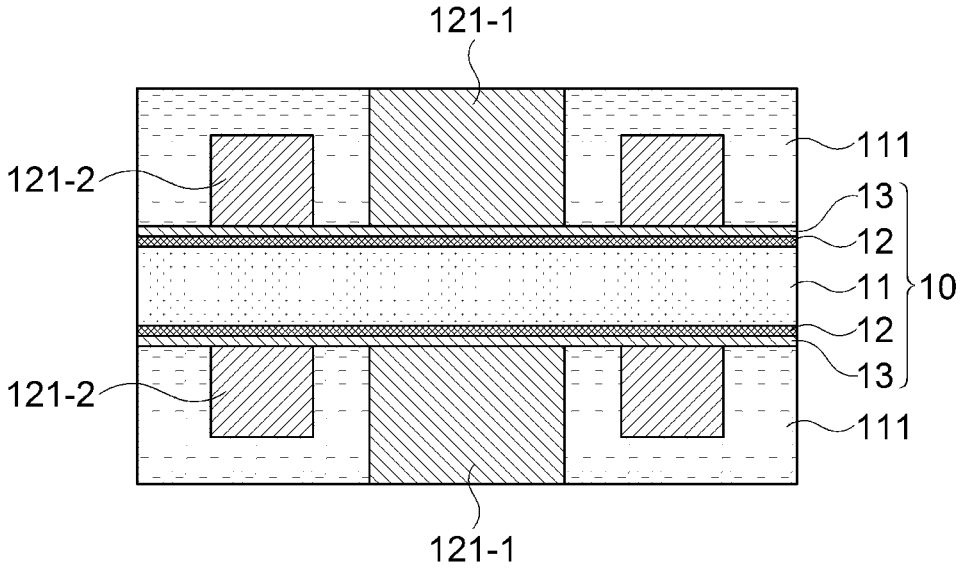

Further, as shown in FIG. 4D, electroplating may be carried out using the metal layer 13 as an electrode, so that the areas of metal layers exposed in operation S115 (the areas of metal layers from which the portion of the first insulating layer is removed) are filled with a conductive material, on each of a pair of the metal layers 13, thereby forming the first plating layer 121-1 of coil patterns having a different thickness (S116). Therefore, the first plating layer 121-1 formed in operation S116, is embedded in the first insulating layer 111, as shown in FIG. 4D.

Herein, the first plating layer 121-1 formed in operation S116 may be formed of at least one material or a mixture of at least two materials selected from the group consisting of copper (Cu), gold (Au), silver (Ag), aluminum (Al) and nickel (Ni), like the first plating layer 121-2 formed in operation S112, but the present disclosure is not limited thereto.

In addition, the first plating layer 121-1 formed in operation S116 may be formed by unidirectional plating, as shown in FIG. 4D, but the present disclosure is not limited thereto, and of course, it may be formed by not only unidirectional plating, but also bidirectional plating, and the like.

Also, after the step of carrying out the forming of the first plating layer and the first insulating layer as described above (S110), a via hole may be processed for electrical connection between each coil pattern, and external circuit patterns, and the processed via hole may be plated by a process such as desmear and chemical copper to form a conductive via hole (not shown). The via hole may be processed by a mechanical method, a laser or photolithography process, or the like, but the present disclosure is not necessarily limited thereto.

Next, FIGS. 5A to 5D are process charts illustrating S120 of FIG. 2, that is, a process of forming a second plating layer and a second insulating layer.

As illustrated in FIGS. 2 and 5A to 5D, a step of forming the second plating layer and the second insulating layer according to the present exemplary embodiment (S120) may include forming second plating resist corresponding to a second plating layer of coil patterns having an identical thickness among a plurality of coil patterns on the first insulating layer, thereby exposing predetermined areas of the first insulating layer (S121), forming second plating resist of coil patterns having an identical thickness on the areas of the first insulating layer exposed in operation S121 (S122), removing the second plating resist formed in operation S121 (S123), forming a second insulating layer on the areas of the first insulating layer from which the second plating resist is removed in operation S123, and the second plating layer of coil patterns having an identical thickness (S124), removing a portion of the second insulating layer corresponding to the second plating layer of coil patterns having a different thickness among a plurality of coil patterns, thereby exposing the first plating layer formed in operation S116 (S125), and forming the second plating layer of coil patterns having a different thickness on the first plating layer exposed in operation S5125 (S126).

Figure 5A:
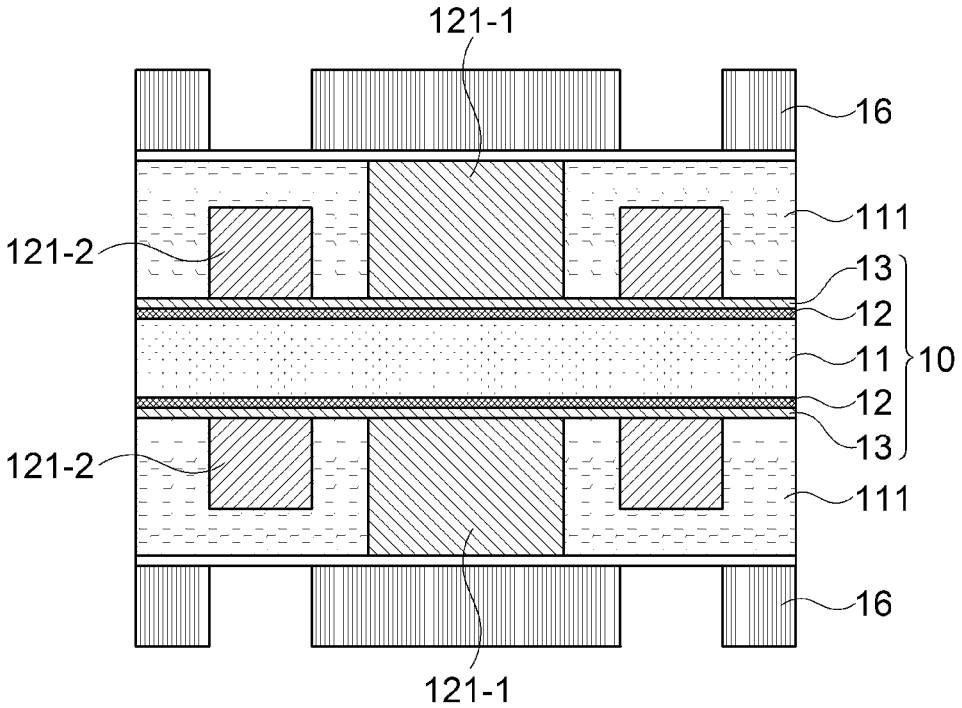
FIGS. 5A through 5D are process charts illustrating a step of forming a second plating layer and a second insulating layer of FIG. 2.

Reviewing the step of forming of the second plating layer and the second insulating layer (S120) according to the present exemplary embodiment more specifically, first, as shown in FIG. 5A, second plating resist 16 corresponding to a second plating layer of coil patterns having an identical thickness among a plurality of coil patterns is formed on each of the first insulating layer 111, so that the predetermined areas of the first insulating layer 111 (the areas of the second plating layer of coil patterns having an identical thickness) may be exposed (S121).

Herein, as the second plating resist 16, dry film resist (DFR) may be used, like the first plating resist 14 in operation S111, but the present disclosure is not limited thereto, and if a plating layer of coil patterns is formable, any type of resist pattern such as photoresist is possible.

Figure 5B:
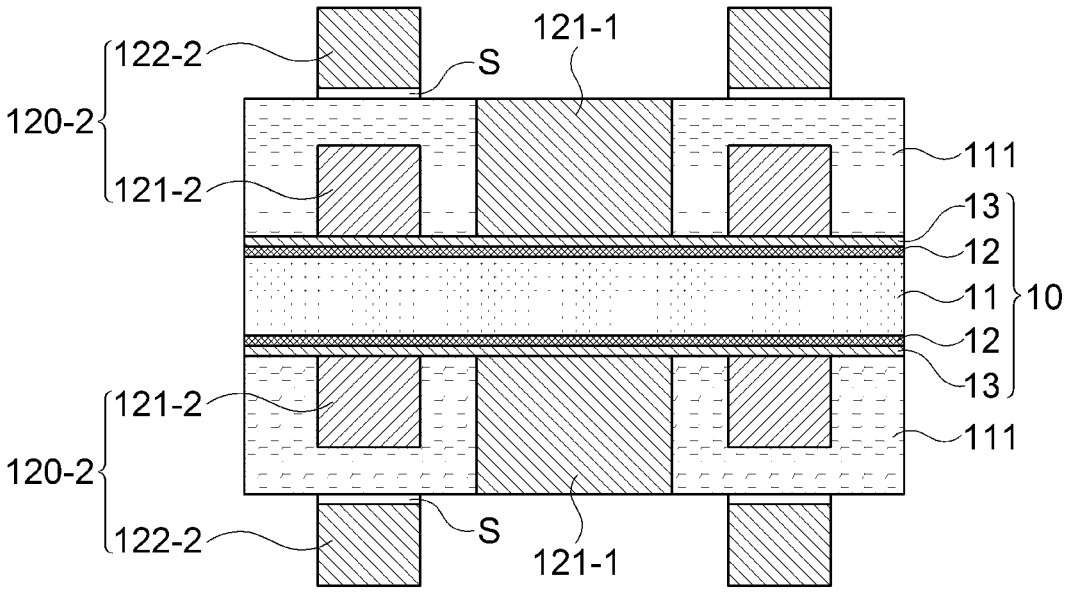

Further, as shown in FIG. 5B, electroplating may be carried out, so that the areas of the first insulating layer exposed in operation S121 (the areas of the first insulating layer where the second plating resist 16 is not formed) are filled with a conductive material, thereby forming the second plating layer 121-2 of coil patterns having an identical thickness (S122).

Herein, the second plating layer 122-2 formed in operation S122 may be formed of at least one material or a mixture of at least two materials selected from the group consisting of copper (Cu), gold (Au), silver (Ag), aluminum (Al) and nickel (Ni), but the present disclosure is not limited thereto.

In addition, the second plating layer 122-2 formed in operation S122 may be formed by unidirectional plating, as shown in FIG. 5B, but the present disclosure is not limited thereto, and of course, it may be formed by not only unidirectional plating, but also bidirectional plating, and the like.

Also, the second plating layer 122-2 formed in operation S122 may further include a metal seed layer S as an electrode for electroplating, as shown in FIG. 5B, and accordingly, the second plating layer 122-2 formed in operation S122 may be formed of a plurality of plating layers. However, the present disclosure is not limited thereto, and at least one of the first and second plating layers may be formed of a plurality of plating layers. Thus, the first plating layer as well as the second plating layer may be formed of a plurality of plating layers.

Accordingly, according to the manufacturing method of the present exemplary embodiment, the plating layer of the coil patterns is formed of plural layers, as previously described, and thus, the cross-sectional area of the coil patterns is adjustable, through which a degree of design freedom of thin film inductor characteristics (for example, an impedance property) may be more improved.

Further, by removing the second plating resist 16 by a process such as light exposure, development and the like, the second plating layer 122-2 of coil patterns having an identical thickness may be formed, on the first insulating layer 111, as shown in FIG. 5B.

Figure 5C:
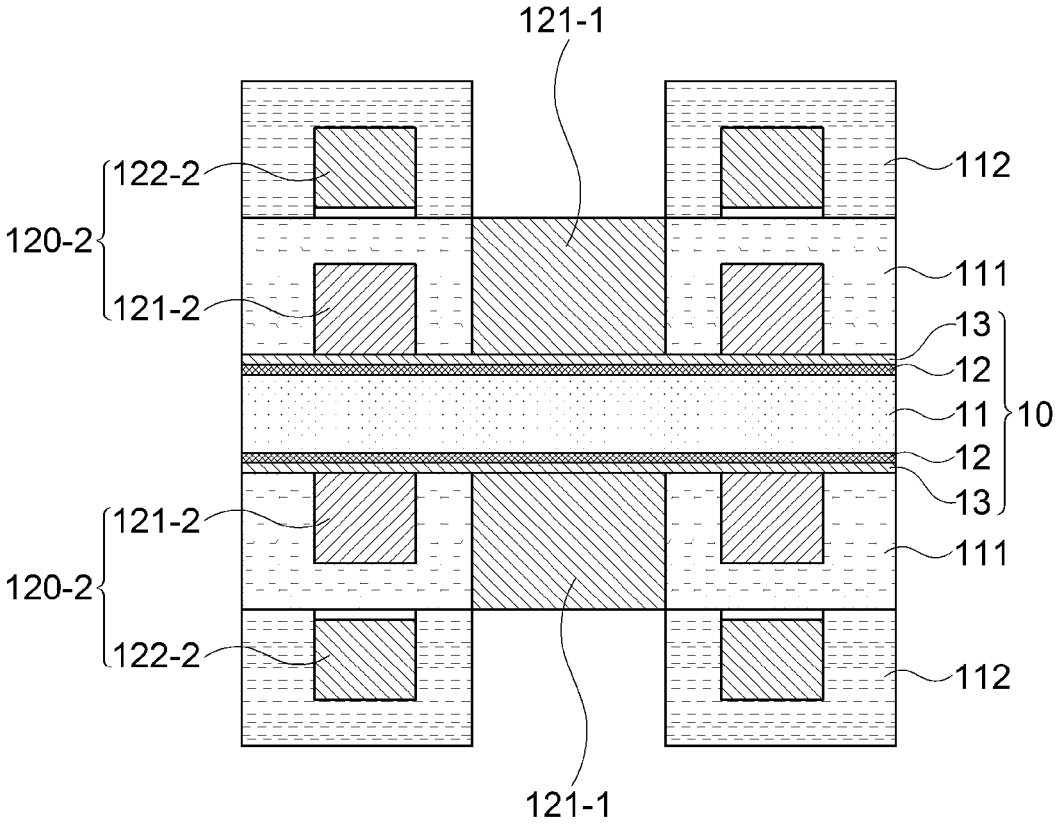

Further, a second insulating layer 112 is formed to intervene in the areas of the first insulating layer from which the second plating resist 16 is removed in operation S123, and the second plating layer 122-2 formed in operation S122 (S114), thereby embedding the second plating layers 122-2 formed in operation S122 in the second insulating layer 112, as shown in FIG. 5C. Herein, the second insulating layer 112 may be formed of a photosensitive insulating layer, but the present disclosure is not limited thereto, and any material having an insulating property may be used.

Further, as shown in FIG. 5C, by removing the portion of the second insulating layer corresponding to the second plating layer of coil patterns having a different thickness among a plurality of coil patterns by a process such as light exposure, development, or the like, the first plating layer 121-1 formed in operation S116 may be exposed (S125).

Figure 5D:
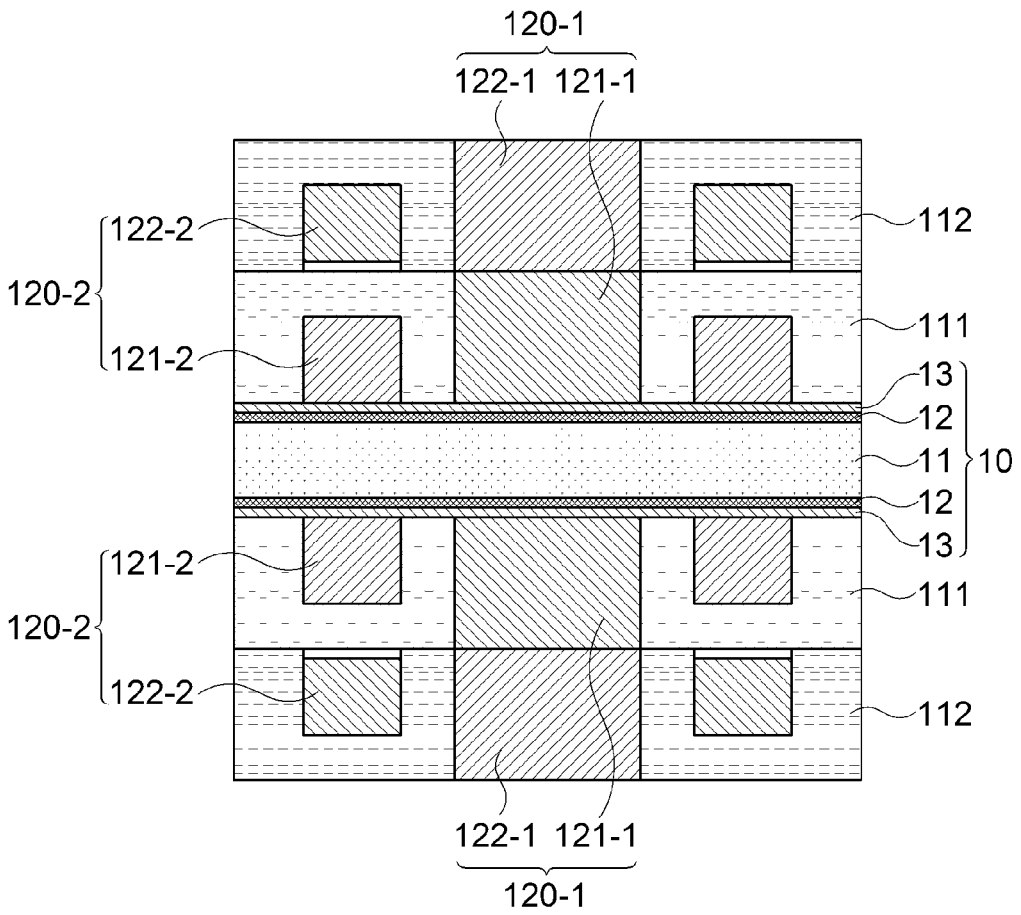

Further, as shown in FIG. 5D, electroplating is carried out, so that the first plating layer 121-1 exposed in operation S125 may be filled with a conductive material, thereby forming the second plating layer 122-1 of coil patterns having a different thickness 120-1 (S126). Therefore, the second plating layer 122-1 formed in operation S126, is embedded in the second insulating layer 112, as shown in FIG. 5D.

Herein, the second plating layer 122-1 formed in operation S126 may be formed of at least one material or a mixture of at least two materials selected from the group consisting of copper (Cu), gold (Au), silver (Ag), aluminum (Al) and nickel (Ni), like the second plating layer 122-2 formed in operation S122, but the present disclosure is not limited thereto.

In addition, the second plating layer 122-1 formed in operation S126 may be formed by unidirectional plating, as shown in FIG. 5D, but the present disclosure is not limited thereto, and of course, it may be formed by not only unidirectional plating, but also bidirectional plating, and the like.

Figure 6A:
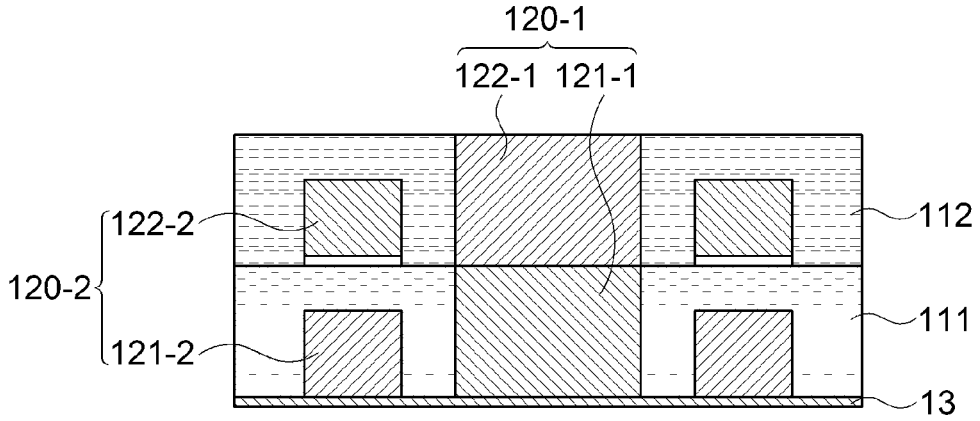
FIGS. 6A through 6C are process charts illustrating steps of separating a metal layer and forming insulating resist of FIG. 2.
Figure 6B:
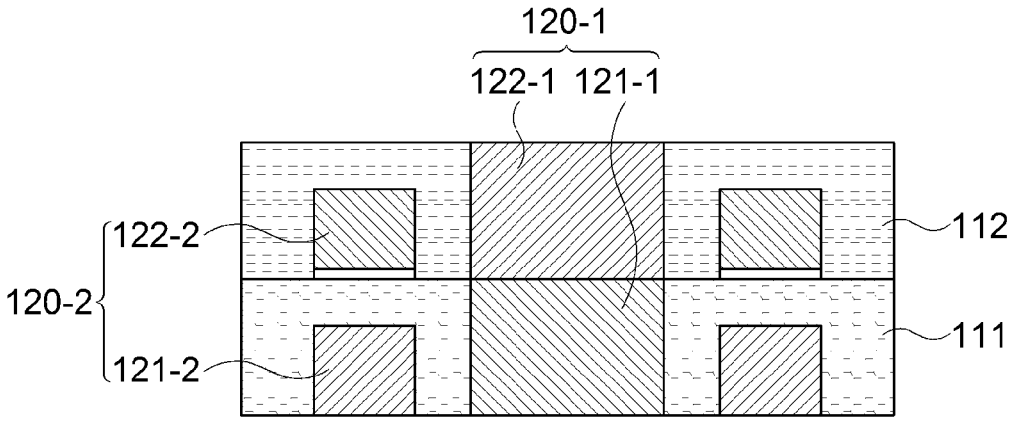
Figure 6C:
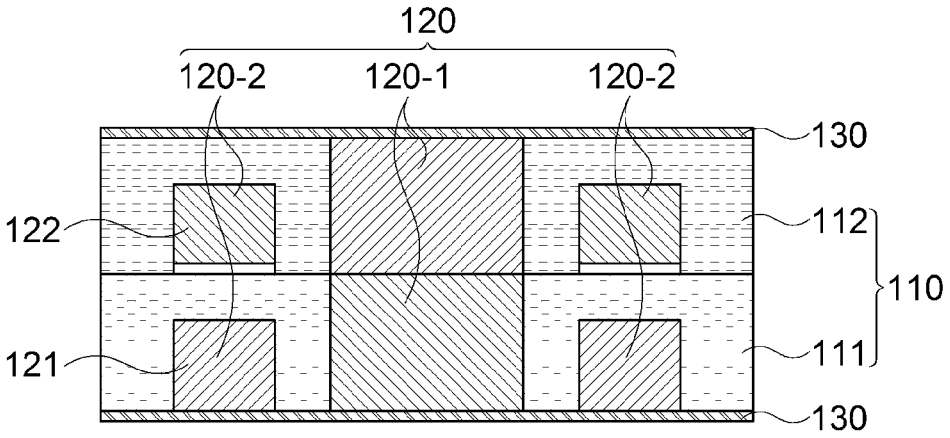

Next, FIGS. 6A to 6C are process charts illustrating operations S130 and S140 of FIG. 2, that is, steps of separating a metal layer and forming insulating resist.

In a step of separating the metal layer according to the present exemplary embodiment (S130), a pair of metal layers may be separated from a substrate layer, as shown in FIGS. 2 and 6A.

That is, as shown in FIG. 6A, in the step of separating the metal layers (S130) according to the present exemplary embodiment, a pair of the metal layers 13 may be separated from the substrate layer 11 of FIG. 5D, and accordingly, two coil units for a thin film inductor may be manufactured in one process. Thus, the simplification of the manufacturing process allows mass production.

In addition, in the step of separating the metal layers (S130) according to the present exemplary embodiment, referring to FIG. 3, on both surfaces of the substrate layer 11, adhesive layers 12 having adhesive strength reduced by a predetermined factor are stacked, and on the adhesive layers 12, metal layers 13 are bonded, respectively. Thus, the metal layers 13 may be separated after reducing the adhesive strength of the adhesive layer 12 by applying a predetermined factor to the adhesive layers 12.

In this case, the predetermined factor reducing the adhesive strength of the adhesive layer 12 may be ultraviolet rays or heat. That is, in case where an adhesive in which a material generating gas by UV irradiation is combined, is used to form the adhesive layer 12, when irradiating the adhesive layer with UV for separating the metal layers 13, gas is generated within the adhesive layer 12 to change the volume of the adhesive layers 12, thereby reducing the adhesive strength. In addition, in case where a foamable adhesive in which a material to be foamed by heat of a predetermined temperature is combined, is used to form the adhesive layer 12, if heat of a predetermined temperature is applied when the metal layers 13 are intended to be separated, foam is generated within the adhesive layers 12 to form unevenness of bonded surfaces, thereby reducing the adhesive strength.

Next, the step of separating the metal layers (S130) according to the present exemplary embodiment, may include a step of removing the metal layers by etching (S131), as shown in FIG. 6B.

That is, in the step of separating the metal layers (S130) according to the present exemplary embodiment, a pair of the metal layers 13 separated from the substrate layer 11 may be removed by etching, as shown in FIG. 6B.

Next, the method of manufacturing the coil unit for a thin film inductor according to the present exemplary embodiment may further include a step of forming insulating resist (S140), after the step of separating metal layers (S130), especially the step of removing the metal layers 13 by etching (S131), as shown in FIGS. 2 and 6C.

That is, solder resist 130 for insulation may be formed on the upper and the lower surfaces of the insulating material 110, that is, the lower surface of the first insulating layer 111 and the upper surface of the second insulating layer 112, as shown in FIG. 6C. However, the present disclosure is not limited thereto, and thus, the solder resist 130 may be formed only on a portion of the first plating layer 121 exposed to the lower surface of the first insulating layer 111, and a portion of the second plating layer 122 exposed to the upper surface of the second insulating layer 112, and further, any insulating resist capable of protecting the exposed portion of the first and second plating layers 121 and 122 may be used.

Eventually, according to the manufacturing method of the present exemplary embodiment, at least one coil pattern has a thickness different from that of rest of the coil patterns. Herein, the present exemplary embodiment exemplifies the case where one coil pattern 120-1 has a thickness different from that of rest of the coil patterns 120-2, as shown in FIG. 6C, but the present disclosure is not limited thereto, and of course, a manufacturing method wherein two or more coil patterns have a thickness different from that of rest of the coil patterns, may be adopted.

Therefore, according to the manufacturing method of the present exemplary embodiment, in the formation of the coil unit for a thin film inductor, at least one coil pattern may have a thickness different from that of rest of the coil patterns, and through the thickness adjustment, each of the cross-sectional areas of coil patterns may be formed to be adjusted differently. Accordingly, the thin film inductor characteristics such as impedance may be formed to be more freely designed.

In addition, according to the manufacturing method of the present exemplary embodiment, since a plurality of coil patterns 120 are formed to be embedded in the insulating material 110, as shown in FIG. 6C, the total thickness of the coil unit may be reduced, as compared with a coil unit having coil patterns formed on the upper and the lower sides of the insulating material, and thus, the miniaturization and thinness of the thin film inductor having the coil unit may be achieved.

Meanwhile, according to the manufacturing method of the present exemplary embodiment, double insulating layers (first and second insulating layers) may be formed by the step of forming the first and the second insulating layers, and thus, the thickness of the insulating material is more freely adjustable, as compared with the case having a single insulating layer. Therefore, according to the manufacturing method of the present exemplary embodiment, an insulating distance between a coil pattern and a magnetic body, spacing between coils, and the like are freely adjustable, and thus, a capacitance characteristic of a thin film inductor may be formed to be more freely designed.

In addition, according to the manufacturing method of the present exemplary embodiment, the first insulating layer 111 may be formed of a mixture of prepreg (PPG) and a resin, and the second insulating layer 112 may be formed of a resin type. However, the present disclosure is not limited thereto, and any material is possible, if it may embed and protect a plurality of coil patterns 120.

Therefore, in the manufacturing method of the present exemplary embodiment, the first insulating layer 111 may be formed of a resin type, and the second insulating layer 112 may be formed of a mixture of a prepreg and a resin, and also various applications such as those formed of at least one material or a mixture of at least two materials selected from the group consisting of an acryl-based polymer, a phenol-based polymer and a polyimide-based polymer, are possible.

<Thin Film Inductor and Method Manufacturing the Same>

Figure 7:
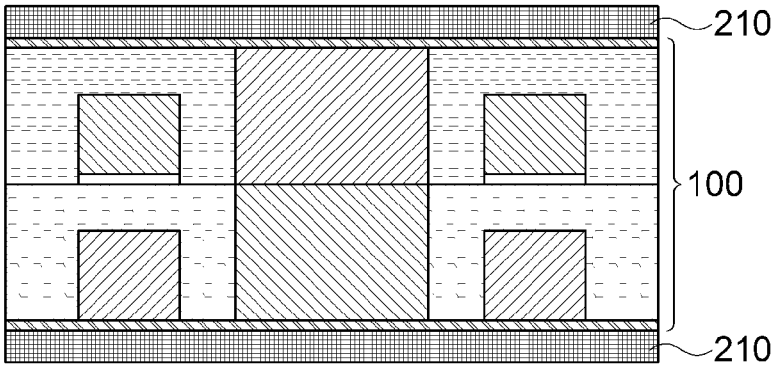
FIG. 7 is a schematic cross-sectional view of a thin film inductor according to an exemplary embodiment of the present disclosure.

FIG. 7 is a schematic cross-sectional view of a thin film inductor 200 according to an exemplary embodiment of the present disclosure.

Referring to FIG. 7, a thin film inductor 200 according to the present exemplary embodiment may be formed by including magnetic bodies 210 joined to the coil unit 100 for the thin film inductor according to the present exemplary embodiment as shown in FIG. 1.

Herein, in the present exemplary embodiment, the case where magnetic bodies 210 are joined to both surfaces of the coil unit 100 for the thin film inductor is exemplified, but the present disclosure is not limited thereto, and the magnetic body 210 may be joined to only an upper surface or a lower surface of the coil unit 100 for the thin film inductor, thereby forming the thin film inductor 200.

Herein, in case where the magnetic bodies 210 are joined to the coil unit 100 for the thin film inductor, a polymer such as epoxy or polyimide, or another adhesive may be used in the joining.

In addition, as the magnetic body 210, the existing ferrite powder may be used as it is, and also ferrite formed on a glass or another substrate may be used as the magnetic body, and further, a stacked film of a soft magnetic film or an insulating film formed by a thin film manufacturing process may be used.

Meanwhile, the thin film inductor 200 shown in FIG. 7 may be formed by including a step of forming the coil unit 100 for the thin film inductor formed according to the manufacturing method of the present exemplary embodiment as previously described, that is, the coil unit 100 for the thin film inductor as shown in FIG. 1, and then joining a magnetic body 210 to at least one of the upper and the lower surfaces of the coil unit 100 for the thin film inductor.

According to the present disclosure as described above, miniaturization and thinness are possible, and thin film inductor properties are more freely designable.

In addition, according to the present disclosure as described above, the simplification of the manufacturing process allows mass production.

In the present specification, referring to "an exemplary embodiment" of the principles of the present disclosure, and various variants of this expression means that a certain characteristic, structure, property, and the like regarding the exemplary embodiment are included in at least one exemplary embodiment of the principles of the present disclosure. Therefore, the expression "in an exemplary embodiment", and other optional variant examples disclosed throughout the present specification do not necessarily refer to an identical example.

Among the drawings of the present disclosure, there is a drawing illustrating process steps, but those steps are certain steps illustrated for obtaining a preferred result, and it is not to be construed that those steps should be carried out, or all steps as illustrated should be carried out. In a certain case, multitasking and parallel step proceeding may be preferred.

In the present specification, the expression 'at least one of . . . ' in 'at least one of A and B' is used to embrace the selection of first option A only, or the selection of second listed option B only, or the selection of both options A and B. For additional example, 'at least one of A, B and C' may embrace the selection of first listed option A only, or the selection of second listed option B only, or the selection of third listed option C only, or the selection of first and second listed options A and B only, or the selection of second and third listed options B and C only, or the selection of first and third listed options A and C only, or the selection of all three options A, B and C. Also in case where more items are listed, it may be clearly extended and interpreted by a person skilled in the art.

Hereinabove, the present disclosure has been described with reference to the preferred exemplary embodiments thereof. All of the exemplary embodiments and conditional examples disclosed in the present specification are illustrated with the intent to help a reader who is a person with ordinary skill in the art to which the disclosure pertains to understand the principle and the concept of the present disclosure, and a person skilled in the art may understand that the present disclosure is implemented in a modified form within a scope without departing from the essential characteristics of the present disclosure. Therefore, the disclosed exemplary embodiments should be considered not from a limited view, but from a descriptive view. The scope of the present disclosure should be defined by the following claims rather than the above-mentioned description, and all technical sprits equivalent to the following claims should be interpreted as being included in the present disclosure.

What is claimed is:

1. A coil unit for a thin film inductor comprising:

an insulating material having double insulating layers of a first and a second insulating layers; and a plurality of coil patterns formed to be embedded in the insulating material, wherein the plurality of coil patterns comprise:

a coil pattern penetrating the first insulating layer and the second insulating layer and having a thickness corresponding to a thickness of the double insulating layers; and a coil pattern embedded in the first insulating layer or the second insulating layer and having a thickness less than a thickness of the first or second insulation layer having the coil pattern embedded therein.

2. The coil unit for a thin film inductor according to claim 1, wherein the coil patterns include:

a first plating layer formed to be embedded in the first insulating layer; and a second plating layer formed to be embedded in the second insulating layer.

3. The coil unit for a thin film inductor according to claim 2, wherein the first and the second insulating layers are photosensitive insulating layers.

4. The coil unit for a thin film inductor according to claim 3, wherein the first insulating layer is formed of a mixture of prepreg and a resin, and the second insulating layer is formed of a resin.

5. The coil unit for a thin film inductor according to claim 3, wherein the first insulating layer is formed of a resin, and the second insulating layer is formed of a mixture of prepreg and a resin.

6. The coil unit for a thin film inductor according to claim 2, wherein at least one of the first and the second plating layers is formed of a plurality of plating layers.

7. The coil unit for a thin film inductor according to claim 1, further comprising insulating resist formed on an upper surface and a lower surface of the insulating material.

8. The coil unit for a thin film inductor according to claim 2, further comprising insulating resist formed on a portion of the first plating layer exposed to a lower surface of the first insulating layer and a portion of the second plating layer exposed to an upper surface of the second insulating layer.

9. A thin film inductor comprising:

the coil unit for a thin film inductor according to claim 1; and a magnetic body joined to at least one of an upper surface or a lower surface of the coil unit for a thin film inductor.

* * * * *